United States Patent [19]

Plath

[11] Patent Number: 4,741,181

[45] Date of Patent: May 3, 1988

[54] CIRCULAR KNITTING MACHINE WITH NEEDLES AND HOLDING-DOWN PLATE MEMBERS

[75] Inventor: Ernst-Dieter Plath, Albstadt, Fed. Rep. of Germany

[73] Assignee: Sipra Patententwicklungs-und Beteiligungsgesellschaft mbH, Albstadt, Fed. Rep. of Germany

[21] Appl. No.: 905,667

[22] Filed: Sep. 8, 1986

[30] Foreign Application Priority Data

Sep. 14, 1985 [DE] Fed. Rep. of Germany ..... 3532856

[51] Int. Cl.[4] ..... D04B 15/06; D04B 35/32

[52] U.S. Cl. ..... 66/104; 66/106; 66/115; 66/168

[58] Field of Search ..... 66/104, 106, 115, 168

[56] References Cited

U.S. PATENT DOCUMENTS

| | | | |
|---|---|---|---|
| 420,772 | 2/1890 | Cochrane | 66/104 X |
| 670,828 | 3/1901 | Williams | 66/115 X |
| 1,758,079 | 5/1930 | Kappes | 66/168 X |
| 3,274,803 | 9/1966 | Schmidt | 66/168 |
| 3,535,895 | 10/1970 | Krauss | 66/168 |
| 3,949,572 | 4/1976 | Kopal et al. | 66/115 |
| 4,546,623 | 10/1985 | Kühn et al. | 66/104 |

FOREIGN PATENT DOCUMENTS

| | | | |
|---|---|---|---|
| 1061943 | 7/1959 | Fed. Rep. of Germany | 66/168 |
| 3311361 | 10/1984 | Fed. Rep. of Germany | 66/104 |
| 1160660 | 8/1969 | United Kingdom | 66/168 |
| 878832 | 11/1981 | U.S.S.R. | 66/168 |

*Primary Examiner*—Wm. Carter Reynolds
*Attorney, Agent, or Firm*—Michael J. Striker

[57] ABSTRACT

A knitting machine for producing mesh products has a needle carrier provided with a plurality of guiding grooves having an upper groove end and a base, a plurality of needles and a plurality of plate members alternatingly arranged in the guiding grooves so that the plate members are longitudinally displaceable and turnable in the guiding grooves and have a rear side abutting against the base of the guiding grooves. The knitting machine further has a device for cleaning at least one location and supplying an air stream which raises in the guiding grooves upwardly toward the groove end into a space formed between the rear side of the plate members and the base of the guiding grooves and limited from below by a turning region by the plate members.

8 Claims, 2 Drawing Sheets

FIG. 1
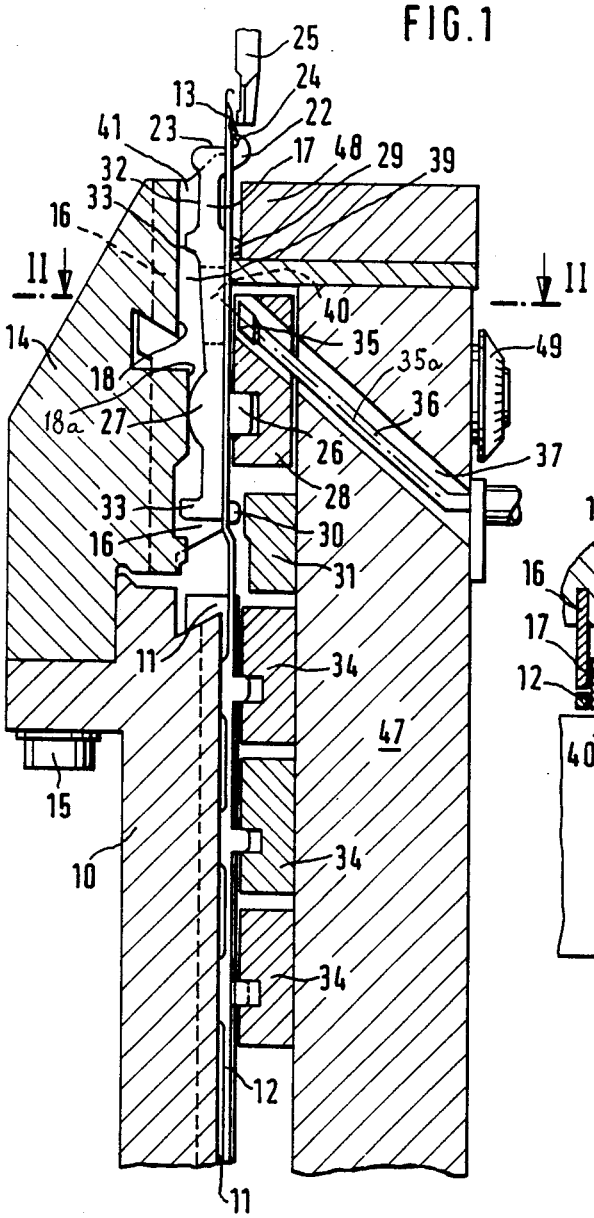
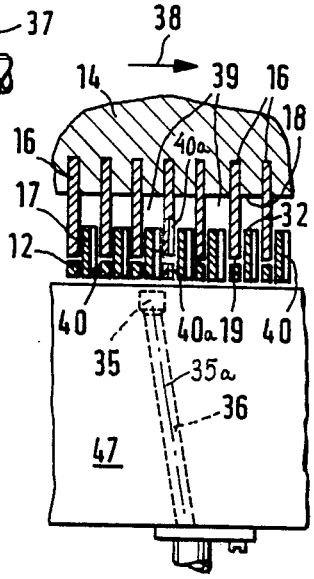
FIG. 2

FIG. 3
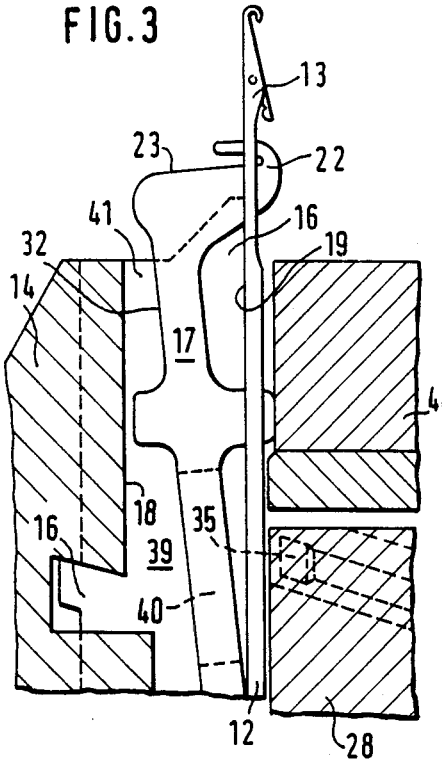
FIG. 4
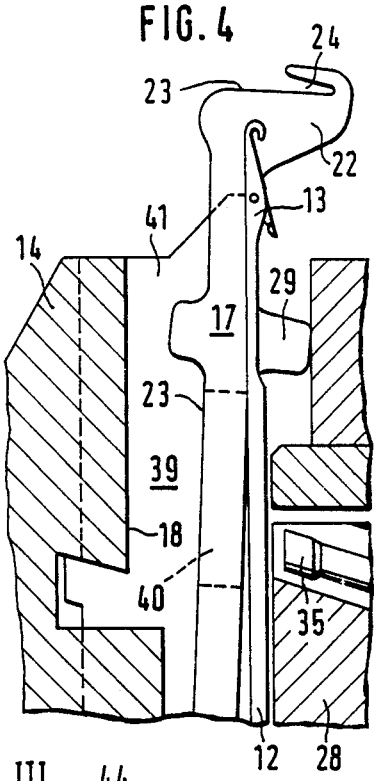
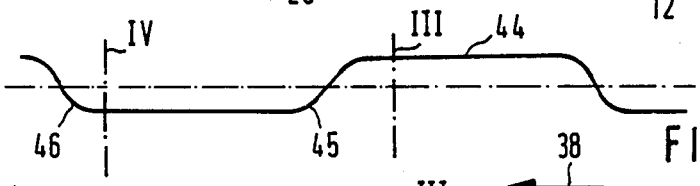
FIG. 6
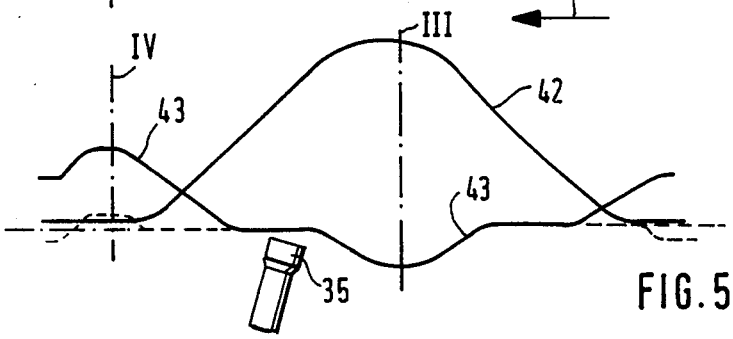
FIG. 5

CIRCULAR KNITTING MACHINE WITH NEEDLES AND HOLDING-DOWN PLATE MEMBERS

BACKGROUND OF THE INVENTION

The present invention relates to a circular knitting machine for producing mesh products by means of needles and holding-down plate members which are arranged alternatingly near one another in guiding grooves of a cylindrical needle carrier. The plate members have on their heads a mesh knocking edge and a holding-down notch, and the plate members are arranged displaceably in a longitudinal direction and also turnably under the action of cam parts of an outer cam carrier. The plate members are provided at their rear side with a projection which abuts against a base of the guiding groove and forms a turning region. Finally, the plate members are provided at their front side with a longitudinal control foot and at both sides with a pressing feet.

A knitting machine of the above mentioned general type is disclosed, for example, in the German document DE-OS No. 3,311,361 of the inventor. In this machine the needles and the holding-down plate members are displaced by special control curves so that the plate members with their knocking edges are at least locally displaced during pulling movement of the associated needles, longitudinally and in an opposite direction. Since the plate members perform a combined longitudinal and turning movement, there is an increased danger that the flying fibers and dust penetrating into the guiding grooves are pressed during the plate members movement against the base of the guiding grooves and therefore are compressed there. Due to the irregular and not frequent maintenance of the machines, the compressed fiber layer can affect both the longitudinal movement and the turning of the plate members. This in turn can lead to binding errors in knitting and to destruction of machine parts. The maintenance expenses for the respective circular knitting machines are however very high. For removing the fiber layer which is compressed in the guiding grooves, all cam parts, needles and holding down plate members must be removed from the machine. Finally, the fiber deposit must be removed from each guiding groove with a suitable tool since blowing with the pressure air is no longer sufficient for such removal.

SUMMARY OF THE INVENTION

In keeping with these objects and with others which will become apparent hereinafter, one object of the present invention resides, briefly stated, in a round knitting machine of the above mentioned type in which no flying fibers can deposit in the guiding grooves for the plate members and compressed by the movement of the plate members.

In keeping with these objects and with others which will become apparent hereinafter, one feature of the present invention resides, briefly stated, in the circular knitting machine which is provided at least at one location of its circumference with a cleaning means which produce an air stream raising in guiding grooves of a needle carrier to an upper groove end, toward a space formed between a rear side of holding-down plates and a base of the guiding grooves.

With the provision of the above cleaning means the above described complicated maintenance of the machine can practically be dispensed with and the output of the machine can be considerably increased. Simultaneously, the blowing air stream provides a cooling action in the upper part of the needle carrier near the mesh forming region.

It is basically known to prevent flying fiber contamination of the mesh forming tool in a knitting machine by means of air blow in the mesh forming region. However, a desirable aspiration from the critical space between the rear side of the plate members and the base of the guiding grooves during combined longitudinal and transverse movement of the plate members is not achieved in the known constructions. Also, known blowing devices which extend in the cam region and in the annular gap between the cam member and the needle cylinder and spread a lubricant cannot achieve the objects of the present invention, since the desired aspiration of the dangerous space possesses considerable difficulties because this space is not accessible.

In accordance with advantageous embodiment of the invention, the air stream reaches the cleaning location by means of a blowing nozzle arranged in the cam region and having a width extending at least over the width of one guiding groove. At the height of the blowing nozzle, the holding down plate members and/or the needle shafts and the guiding webs for the plate members are provided with a thickness reducing recess which forms an air passage into the space at the rear side of the holding down plate members. Here the guiding grooves of the needle cylinder are moved after the other to the cleaning location whose blowing nozzle is arranged in the stationary cam element of the machine. The advantage is that the pressure air which is available from a single blowing nozzle or from a small number of individual blowing nozzles can be concentrated to provide a respective concentrated cleaning action. Here also there is a considerable difference from conventional blowing devices which is used in the knitting forming region in which a greater number of blowing nozzles distributed over the entire periphery of the machine are used.

It is also basically known to provide recesses on the shafts of the knitting tools such as needles and plate members. However this was done for other purposes and at other locations, for example for providing a free space for needles and plate members near the latch impact or to achieve a special bending shape of the shaft or to provide a vibration damping zone in the needle needle shaft.

In the inventive circular knitting machine the lateral recess and the blowing nozzle are formed or arranged in the region between the turning location of the plate members and the upper groove end. The lateral recess in the holding-down plate and/or in the needle shaft has advantageously a length which corresponds to at least maximum stroke of the respective one of these parts. Advantageously, the lateral recess in the holding down plate is located at a forward side in the rotary direction of the needle cylinder, to provide favorable flow conditions. Also, for providing favorable flow conditions, the axis of the outlet of the blowing nozzle is advantageously inclined to the longitudinal direction of the guiding groove and also inclined to a radial plane which extends through the guiding groove.

The cleaning action of the cleaning means of the inventive circular knitting machine can be increased when one or several blowing nozzles are arranged in the region of the cam means in which the plate members with their head are turned radially outwardly and respectively their rear sides have a greater distance from the base of the guiding groove. Moreover, the base of the guiding grooves for the plate members can be formed above the turning region of the plate members inclined to the longitudinal direction of the guiding groove, so that the guiding groove at its upper end has a greater depth than in the turning region. In both cases the air stream has relatively large flow passage. The cross section of the blowing nozzle can be not round. When at the cleaning location simultaneously several guiding grooves must be overlapped, the nozzle can be provided with a nozzle opening which is elongated in a peripheral direction of the machine. Also, the blowing nozzle opening can be limited by the width of one guiding groove can be formed elongated in the longitudinal direction of the guiding grooves.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a radial partial longitudinal section through a needle and plate members curve as well as a cam cylinder of a circular knitting machine in accordance with the present invention;

FIG. 2 is a partial transverse section through an etched region of the plate members cylinder and through the cam member along the line II—II in FIG. 1, turned by 90°;

FIGS. 3 and 4 are partial views on an enlarged scale of the cut of FIG. 1 in different positions of holding down plate members and needles;

FIG. 5 is a view showing control curves for needles and for holding down plate members of the inventive circular knitting machines; and FIG. 6 is a view showing a curve which illustrates the turning position of the holding down plate members of the inventive circular knitting machine.

DESCRIPTION OF PREFERRED EMBODIMENTS

A circular knitting machine shown in FIG. 1 has a needle cylinder 10. The needle cylinder has an outer surface provided with axis-parallel guide webs 11 and arranged so that they limit guide grooves for a respective shaft 12 of a latch-type needle 13.

A plate cylinder 14 is arranged above the needle cylinder 10 coaxially therewith and fixedly connected with the needle cylinder by a screw 15. The plate cylinder 14 has an outer surface provided with axis-parallel guide webs 16 which are arranged with gaps relative to the guide webs 11 of the needle cylinder. Holding-down plate members 17, which will be called later on shortly plate members, are located between the guide webs 16. The plate members are supported in a longitudinally displaceable and turnable manner. The needle cylinder 10 and the coaxial plate cylinder 14 are surrounded by a common cam element 47 which has cam members for controlling the needles 13 and the plate members 17. The control members for controlling the needles 13 are identified with reference numeral 34.

The plate members 17 are formed as holding-down and knocking-over plate members with heads 22 characteristic of this type of the plate members. They have a sinking edge 23 and a holding-down throat 24. A not-shown thread is guided through a thread guide 25. The plate member 17 is provided at its rear side 32 with a rounded projection 27 which forms a turning region to be supported on a supporting portion 18a a base 18 of its guiding groove. The plate member 17 is also provided at the level of its projection 27 but at its front side, with a control foot 26. The control foot 26 controls the longitudinal movement of the plate member by means of special control members for the plate members, of which one control member 28 is shown in FIG. 1.

The plate members 17 also have an upper pressing foot 29 and a lower pressing foot 30. For obtaining the turning movement of the plate members, pressing control members 48 and 31 act upon the pressing feet 29 and 30 in a known manner. The plate members 17 are provided at their rear side 32 with stabilizing projections 33, each at the height of the respective pressing foot 29 and 30. The cam 28 is arranged displacably on an outer adjusting disk 49 for changing the longitudinal displacement of the plate members 17, as illustrated by the course of the control curve 43 in Figure 5 in solid and broken lines.

As can be seen from FIG. 2, the plate members 17 are guided between the guide webs. The shafts 12 of the needles 13 which are guided under the needle cylinder 10 between their guide webs 11 are arranged in front of the end side 19 of the guide webs 16 for the plate members 17.

The radial section of FIG. 1 extends through a special cleaning zone of the machine. A blowing nozzle 35 is directed to guide grooves for the plate members 17, formed between the guide webs 16, in the region of the control member which controls the plate members 17. The blowing nozzle 35 is connected with a pressure air conduit 36 which extends through an inclined passage 37 formed in the common cam element 47. Further cleaning areas each provided with one blowing nozzle 35 can be also arranged at the periphery of the machine. As can be seen from FIG. 2, the conduit 36 and thereby also the longitudinal axis **35*a* of the blowing nozzle 35 which is located at its end, are arranged inclined to a radial plane of the machine. In the shown example the blowing nozzle 35 has the width of a guiding groove for the plate members 17**.

FIGS. 1 and 3 show that the plate members 17 are provided at the height of the blowing nozzle 35 with a lateral recess 40. As can be seen in FIG. 1, the recesses 40 extend over a length which corresponds at least to a stroke of the plate members 17. The lateral recess 40 in accordance with FIG. 2 is arranged at such side of the plate members 17 which is a front side as considered in the direction of rotation of the plate cylinder 14 identified with the arrow 38. A passage for the blowing air is provided by the lateral recess 40, and blowing air reaches a chamber 39 of the guiding grooves. The chamber 39 extends between the rear side 32 of the plate members 17 and the base 18 of the guiding grooves, and extends downwardly to the turning region of the plate members 17 formed by the projection 27. The passage can also be formed or expanded by lateral recesses **40*a* on the guide webs 16 and the needle shafts 12 guided in front of the end side 19**.

In the FIGS. 3 and 4 the region 39 which is to be cleaned by the blowing nozzle 35 in the cleaning location at the rear side 32 of the plates members 17 is shown on an increased scale. FIG. 3 shows the relative position of the plate members 17 to a neighboring needle 13 which it assumes at the location III of the control curves shown in FIGS. 5 and 6. In FIG. 5 a control curve 42 is represntative of the longitudinal movement of the needles 13 and a control curve 43 is representative of the longitudinal movement of plate members 17, while FIG. 6 illustrates a curve 44 which shows the turning position of the plate members 17. FIG. 3 shows the plate members 17 in their holdingdown position, in which their head 17 is turned inwardly against the plate cylinder 14, whereby the space 39 behind the rear side 32 of the plate member 17 is narrowed. In this position of the plate members 17 there is a danger that the fiber material which falls through the upper end 41 of the guiding grooves from the mesh forming region is pressed against the base 18.

FIG. 4 shows the plate member 17 in the position identified as IV in FIGS. 5 and 6, in which it is turned outwardly and the space 39 in the guiding groove is increased behind the rear side 32 of the plate 17 and is widely opened to the guiding groove end 41. There or in another position between points 45 and 46 of the curve 44 shown in FIG. 6 of the turning position of the plate member 17, the cleaning region is associated with the blowing nozzles 35. The blowing air reaches through the gap formed between the lateral recess 40 of the plate members 17, into the space 39 and blows eventually deposited fiber material upwardly and through the end 41 of the guiding passage outwardly. There the active region of another conventional blowing or aspirating device which influences the mesh forming region can start. For enhancing the air stream, the guiding groove base above the turning region of the plate members 17 can also extend in an inclined manner so that the guiding grooves at their upper end 41 has a greater depth than in the turning region.

It will be understood that each of the elements described above, or two or more together, may also find a useful application in other types of constructions differing from the types described above.

While the invention has been illustrated and described as embodied in a knitting machine with needles and holding-down plates, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A knitting machine for producing mesh products, comprising a needle carrier provided with a plurality of guiding grooves each having an upper groove end and a base; a plurality of needles and a plurality of plate members alternatingly arranged in said guiding grooves so that said plate members are longitudinally displaceable and turnable in said guiding grooves and having rear sides abutting against said bases of said guiding grooves; means for cleaning at least one location and supplying an air stream which rises in said guiding grooves upwardly toward said groove ends into a space formed between said rear sides of said plate members and said bases of said guiding guiding grooves; and cam means arranged to control said plate members, each of said guiding grooves having a predetermined width, said needles having needle shafts, said needle carrier having a plurality of guide webs between which said plate members are located, said means for cleaning including a blowing nozzle arranged in the region of said cam means and extending at least over the width of one of said guiding grooves, said blowing nozzle being located at a predetermined height, said plate members being provided at said height with a thickness-reducing lateral recess which forms an air passage to said space.

2. A knitting machine as defined in claim 1, wherein said needle shafts and said guide webs are also provided at said height with a thickness-reducing lateral recess which forms an additional air passage into said space.

3. A knitting machine as defined in claim 1, wherein said lateral recess of said plate members has a length which is equal at least to a maximum stroke of said plate members.

4. A knitting machine as defined in claim 1, wherein said needle carrier is rotatable in a predetermined location, said lateral recess of said plate members being located at a forward side as considered in the direction of rotation of said needle carrier.

5. A knitting machine for producing mesh comprising a needle carrier provided with a plurality of guiding grooves each having an upper groove end and a base; a plurality of needles and a plurality of plate members alternatingly arranged in said guiding grooves so that said plate members are longitudinally displaceable and turnable in said guiding grooves and having rear sides abutting against said bases of said guiding grooves; means for cleaning at least one location and supplying an air stream which rises in said guiding grooves upwardly toward said groove ends into a space formed between said rear sides of said of said plate members and said bases of said guiding grooves; and cam means arranged to control said plate members, each of said guiding grooves having a predetermined width, each of said needles having a needle shaft, said needle carrier having a plurality of guide webs between which said plate members are located, said means for cleaning including a blowing nozzle arranged in the region of said cam means and extending at least over the width of one of said guiding grooves, said blowing nozzle being located at a predetermined height, said needle shafts and said guide webs being provided at said height with a thickness-reducing lateral recess which forms an air passage to said space.

6. A knitting machine as defined in claim 5, wherein said lateral recess in said needle shafts has a length which is equal at least to a maximum stroke of said needle shafts.

7. A knitting machine for producing mesh products, comprising a needle carrier provided with a plurality of guiding grooves each having an upper groove end and a base, a plurality of needles and a plurality of plate members alternatingly arranged in said guiding grooves so that said plate members are longitudinally displaceable and turnable in said guiding grooves and having rear sides abutting against said bases of said guiding grooves; means for cleaning at least one location and supplying an air stream which rises in said guiding groove upwardly toward said grooves ends into a space formed between said rear sides of said plate members and said bases of said guiding grooves; cam means arranged to control said plate members, each of said guiding grooves having a predetermined width, said needles having needle shafts, said needle carrier having a plurality of guide webs between which said plate members are located, said means for cleaning including a blowing nozzle arranged in the region of said cam means and extending at least over the width of one of said guiding grooves; said plate members forming a group of first parts, said needle shafts and said guide webs forming a group of second parts, said blowing nozzle being located at a predetermined height, the parts of at least one of said groups being provided at the height of said blowing nozzle with thickness-reducing recesses which form an air passage to said space, each of said plate members having a projection which cooperates with said base and forms a turning region of said plate members, said recesses and said blowing nozzle being located between said turning region.

8. A knitting machine for producing mesh products, comprising a needle carrier provided with a plurality of guiding grooves each having an upper groove end and a base; a plurality of needles and a plurality plate members alternatively arranged in said guiding grooves so that said plate members are longitudinally displaceable and turnable in said guiding grooves and having rear sides abutting against said bases of said guiding grooves; and means for cleaning at least one location and supplying an air stream which rises in said guiding grooves upwardly toward said groove ends into a space formed between said rear sides of said plate members and said bases of said guiding grooves, said needle carrier having a plurality of guide webs between which said plate members are located, said means for cleaning including a blowing nozzle having an outlet opening with an axis, said outlet being arranged so that said axis is inclined to a longitudinal direction of said guiding grooves, said axis of said outlet opening of said blowing nozzle being arranged so that it is inclined also to a radial plane extending through said guiding grooves.

* * * * *